United States Patent [19]

Boskamp et al.

[11] Patent Number: 4,526,709

[45] Date of Patent: Jul. 2, 1985

[54] BUILT LIQUID DETERGENT COMPOSITIONS CONTAINING ZEOLITE Y

[75] Inventors: Jelles V. Boskamp; Willem M. M. Möhlmann, both of Vlaardingen, Netherlands

[73] Assignee: Lever Brothers Company, New York, N.Y.

[21] Appl. No.: 651,728

[22] Filed: Sep. 19, 1984

[30] Foreign Application Priority Data

Oct. 12, 1983 [GB] United Kingdom ..... 8327271

[51] Int. Cl.[3] ..... C11D 3/06; C11D 3/12; C11D 3/33; C11D 17/08

[52] U.S. Cl. ..... 252/527; 252/131; 252/135; 252/140; 252/155; 252/173; 252/174.25; 252/179; 252/546; 252/DIG. 14

[58] Field of Search ..... 252/131, 140, 155, 173, 252/174.25, 179, 135, 527, 546

[56] References Cited

U.S. PATENT DOCUMENTS

| | | | |
|---|---|---|---|
| 4,072,622 | 2/1978 | Kuhling | 252/179 |
| 4,088,593 | 5/1978 | Roebke | 252/179 |
| 4,215,004 | 7/1980 | Borgerding | 252/156 |
| 4,248,728 | 2/1981 | Puryear | 252/103 |
| 4,265,777 | 5/1981 | Boyer | 252/113 |
| 4,267,068 | 5/1981 | Diessel | 252/179 |
| 4,280,920 | 7/1981 | Garvey | 252/173 |
| 4,368,134 | 1/1983 | Kaeser | 252/140 |
| 4,397,777 | 8/1983 | Yurko | 252/536 |
| 4,405,483 | 9/1983 | Kuzel | 252/140 |
| 4,406,808 | 9/1983 | Gangwisch | 252/91 |

FOREIGN PATENT DOCUMENTS 1058040 7/1979 Canada .

*Primary Examiner*—Dennis L. Albrecht
*Attorney, Agent, or Firm*—Lynne Darcy; James J. Farrell

[57] ABSTRACT

Built liquid detergent compositions containing a mixture of a condensed phosphate and/or a nitrilotriacetate and zeolite 4 A become rapidly unstable at a pH between 7 and 9, which results in phase separation. Using zeolites of the Y-type results in stable products.

3 Claims, No Drawings

BUILT LIQUID DETERGENT COMPOSITIONS CONTAINING ZEOLITE Y

The present invention relates to a liquid detergent composition which comprises a zeolite as builder.

In the past decade, attention has been focussed on zeolites as possible substitutes for the well-known phosphate builder salts. Zeolites are sodium aluminium silicates of varying composition and crystal structure, and of these zeolites particularly the A- and X-types have been recommended for use as phosphate substitute in detergent compositions. According to the prior art, these zeolites are preferably used in conjunction with a water-soluble builder salt. Most of the attention has been paid to the use of these zeolites in particulate detergent compositions, and although the prior art reveals in general terms that these zeolites may also be included in liquid compositions, there are relatively few specific proposals to that effect. One such proposal is laid down in German Patent Application 2,538,679, and concerns a stable, homogeneous composition in the form of a paste, comprising an active synthetic detergent and a diminuted zeolite molecular sieve in cation-exchange form as builder. Any type of crystalline zeolite may be used, such as the crystal structure types, A, X, Y, L. Mordenit and Erionite. The A-type zeolites are again preferred.

However, we have found that when the A-type zeolites are incorporated in liquid detergents which also contain certain other builder salts, and which have a $p_H$ within a certain range, the liquid detergent composition becomes rapidly unstable, resulting in a phase separation. Surprisingly, we have found that under the same conditions the Y-type zeolites do not cause such rapid instability and phase separation.

The $p_H$-range of the $p_H$ of the liquid detergent composition within which the above phenomenon occurs is from 7.0–9.0, and the water-soluble builder salts with which the above phenomenon occurs are the alkali metal condensed phosphates such as sodium tripolyphosphate and tetrasodium pyrophosphate, and the alkali metal nitrilotriacetates such as trisodium nitrilotriacetates.

The present invention therefore relates to a liquid detergent composition comprising a zeolite and a water-soluble builder salt and having a $p_H$ of between 7.0 and 9.0, characterised in that the zeolite is of the Y-crystal-structure type and the water-soluble builder salt is an alkali metal condensed phosphate or an alkali metal nitrilotriacetate.

The zeolites of the Y-crystal-structure type have the following typical unit cell composition:

$$Na_{56}[(AlO_2)_{56}(SiO_2)_{136}].250\ H_2O,$$

and variations thereof, whereby the Na/Al ratio varies from 0.7 to 1.1 and the Si/Al ratio varies from 1.5 to 3, and it may be used in the compositions of the invention in the fully hydrated form or in a partially or completely dehydrated form. The completely hydrated form is, however, preferred.

The amount of zeolite Y which is used according to the present invention may vary from 1 to 45%, preferably from 5 to 35%, and particularly preferably from 5–25%.

The water-soluble builder salts which are used according to the present invention can be present in an amount of from 0.5 to 30%, preferably from 5 to 25%.

Mixtures of these water-soluble builder salts, such as mixtures of sodium tripolyphosphate and trisodium nitrilotriacetates in a weight ratio of 1:10 to 10:1 can also be used.

The compositions of the invention furthermore comprise a detergent active material and further common ingredients usually incorporated in liquid detergent formulations.

The active detergent material may be an alkali metal or alkanolamine soap or a $C_{10}$–$C_{24}$ fatty acid, including polymerized fatty acids, or an anionic, nonionic, cationic, zwitterionic or amphoteric synthetic detergent material, or mixtures of any of these.

Examples of anionic synthetic detergents are salts (including sodium, potassium, ammonium and substituted ammonium salts such as mono-, di- and triethanolamine salts) of $C_9$–$C_{20}$ alkylbenzenesulphonates, $C_8$–$C_{22}$ primary or secondary alkanesulphonates, $C_8$–$C_{24}$ olefinsulphonates, sulphonated polycarboxylic acids, prepared by sulphonation of the pyrolyzed product of alkaline earth metal citrates, e.g. as described in British Patent Specification No. 1,082,179, $C_8$–$C_{22}$ alkylsulphates, $C_8$–$C_{24}$ alkylpolyglycol-ether-sulphates, -carboxylates and -phosphates (containing up to 10 moles of ethylene oxide); further examples are described in "Surface Active Agents and Detergents" (Vol. I and II) by Schwartz, Perry and Berch.

Examples of nonionic synthetic detergents are the condensation products of ethylene oxide, propylene oxide and/or butylene oxide with $C_8$–$C_{18}$ alkylphenols, $C_8$–$C_{18}$ primary or secondary aliphatic alcohols, $C_8$–$C_{18}$ fatty acid amides; further examples of nonionics include tertiary amine oxides with one $C_8$–$C_{18}$ alkyl chain and two $C_{1-3}$ alkyl chains. The above reference also describes further examples of nonionics.

The average number of moles of ethylene oxide and/or propylene oxide present in the above nonionics varies from 1–30; mixtures of various nonionics, including mixtures of nonionics with a lower and a higher degree of alkoxylation, may also be used.

Examples of cationic detergents are the quaternary ammonium compounds such as alkyldimethylammonium halogenides, but such cationics are less preferred for inclusion in enzymatic detergent compositions.

Examples of amphoteric or zwitterionic detergents are N-alkylamino acids, sulphobetaines, condensation products of fatty acids with protein hydrolysates, but owing to their relatively high costs they are usually used in combination with an anionic or a nonionic detergent. Mixtures of the various types of active detergents may also be used, and preference is given to mixtures of an anionic and a nonionic detergent active. Soaps (in the form of their sodium, potassium and substituted ammonium salts) of fatty acids may also be used, preferably in conjunction with an anionic and/or a nonionic synthetic detergent.

The amount of the active detergent material varies from 1 to 60%, preferably from 2–40% and especially preferably from 5–25%; when mixtures of e.g. anionics and nonionics are used, the relative weight ratio varies from 10:1 to 1:10, preferably from 6:1 to 1:6. When a soap is also incorporated, the amount thereof is from 1–40% by weight.

The amount of water present in the detergent compositions of the invention varies from 5 to 70% by weight.

Other conventional materials may also be present in the liquid detergent compositions of the invention, for example soil-suspending agents, hydrotropes, corrosion inhibitors, dyes, perfumes, silicates, optical brighteners, suds depressants such as silicones, germicides, anti-tarnishing agents, opacifiers, fabric-softening agents, oxygen-liberating bleaches such as hydrogen peroxide, sodium perborate or percarbonate, disperisophthalic anhydride, with or without bleach precursors, buffers, enzymes with or withour enzyme stabilizing systems such as polyol/borax, reducing bleaches such as an alkali metal sulphite and so on.

The invention will now further be illustrated by way of example.

EXAMPLE 1

In a model system comprising water, 5% by weight of zeolite and 0.33 mole% of water-soluble builder salt, zeolite 4A was compared with zeolite Y at different $p_H$ values. The zeolite 4A and the zeolite Y had the following composition:

zeolite 4A: $Na_{12}[(AlO_2)_{12}(SiO_2)_{12}].27\ H_2O$
zeolite Y: $Na_{56}[(AlO_2)_{56}(SiO_2)_{136}].250\ H_2O$
As water-soluble builder salt sodium tripolyphosphate (STP) was used.

The zeolite and water-soluble builder salt were brought into 0.5 l distilled water at 23° C. and the mixture was allowed to stand for 2 hours. The $p_H$ was kept constant by adding the required amounts of hydrochloric acid. After two hours, the aqueous mixture was filtered and the remaining liquid was tested for aluminium in solution by means of plasma emission spectroscopy. The decomposition of the zeolite was calculated on the basis of the aluminium found in solution.

The following table I represents the results obtained.

TABLE I

| | HCl consumption (mg. eq.) | | calculated decomposition (in % w/w) | |
|---|---|---|---|---|
| pH | for zeolite 4A | for Zeolite Y | of Zeolite 4A | of Zeolite Y |
| 7.0 | 180 | 0.0 | 37 | 2.6 |
| 7.5 | 124 | 0.0 | 21 | 1.3 |
| 8.0 | 46 | 0.0 | 11 | 0.4 |
| 8.5 | 10 | 0.0 | 1.5 | 0.0 |
| 9.0 | 3 | 0.0 | 0.3 | 0.0 |

The above results show that with zeolite 4A there occurs substantial decomposition within the $p_H$ range of 7 to 8, and some decomposition within the range of 8–9, whereas with zeolite Y there is a very significant reduction in decomposition over the $p_H$ range of 7.0–9.0.

EXAMPLE 2

The above method was used with systems with tetrasodium pyrophosphate (TSPP) or trisodium nitrilotriacetate (NTA) as the water-soluble builder salt. The $p_H$ was now kept at 7.5. The results were as follows:

| | HCl consumption | Decomposition |
|---|---|---|
| Zeolite 4A/TSPP | 195 | 25 |
| Zeolite Y/TSPP | 10 | 0.7 |
| Zeolite 4A/NTA | 0.0 | 4.2 |
| Zeolite Y/NTA | 0.0 | 0.1 |

EXAMPLE 3

The following liquid detergent composition was prepared, to which 6% zeolite 4A and 6% zeolite Y were added respectively (compositions A and B). These compositions were stored for 15 days at 23° C., and their physical stability was measured.

| | A | B |
|---|---|---|
| sodium dodecylbenzene sulphonate | 6.0 | 6.0 |
| potassium oleate | 1.5 | 1.5 |
| $C_{13}$–$C_{15}$ alcohol 7 EO condensate | 2.5 | 2.5 |
| coconut diethanolamide | 1.0 | 1.0 |
| sodium carboxymethylcellulose | 0.1 | 0.1 |
| sodium tripolyphosphate | 25.0 | 25.0 |
| borax | 2.0 | 2.0 |
| glycerol | 5.0 | 5.0 |
| liquid polysiloxane anti-foam compound | 0.2 | 0.2 |
| fluorescent agent | 0.1 | 0.1 |
| enzyme granules (Alcalase marumes) | 0.8 | 0.8 |
| water and perfume | to 100.0 | to 100.0 |
| zeolite 4A } added on top | 6.0 | — |
| zeolite Y } added on top | — | 6.0 |
| pH | 7.5 | 7.5 |

The storage results, expressed in vol.% phase separation, were as follows:

| | 23° C. | 37° C. | 52° C. |
|---|---|---|---|
| composition A: | 8 | 4 | 26 |
| composition B: | 0 | 0 | 0 |

We claim:

1. An aqueous, built liquid detergent composition comprising, in an aqueous medium,
   (a) from 1–60% by weight of an active detergent material;
   (b) from 5–30% by weight of a builder salt selected from the group consisting of alkalimetal condensed phosphates, alkalimetal nitrilotriacetates and mixtures thereof, and
   (c) from 1–45% by weight of a zeolite, wherein the zeolite is a zeolite of the Y-type having the following unit cell composition:

$$Na_{56}[AlO_2)_{56}(SiO_2)_{136}].250\ H_2O,$$

the compositions having a pH of 7–9 and exhibiting stability against phase separation and against decomposition of the zeolite component.

2. The composition of claim 1, comprising 5–25% by weight of (a), 5–25% by weight of (b) and 5–25% by weight of (c).

3. The composition of claim 1, comprising a completely hydrated zeolite of the Y-type.

* * * * *